US005417810A

United States Patent [19]

Morris

[11] Patent Number: 5,417,810

[45] Date of Patent: May 23, 1995

[54] PAPERMACHINE HEADBOX CLEANING SYSTEM

[75] Inventor: Patrick E. Morris, Montrose, Ala.

[73] Assignee: International Paper Comany, Purchase, N.Y.

[21] Appl. No.: 206,085

[22] Filed: Mar. 4, 1994

[51] Int. Cl.[6] ..... D21F 1/00; B08B 9/00

[52] U.S. Cl. ..... 162/199; 162/272; 15/104.5; 134/22.1

[58] Field of Search ..... 162/199, 272; 15/3.5, 15/3.51, 104.5, 40, 77, 88.1; 134/22.1, 6

[56] References Cited

U.S. PATENT DOCUMENTS

| | | | |
|---|---|---|---|
| 1,132,691 | 3/1915 | Sieben | 15/104.12 |
| 1,498,446 | 6/1924 | Geskey | 15/104.31 |
| 2,974,932 | 3/1961 | Xenis . | |
| 3,101,730 | 8/1963 | Harris et al. | 134/167 R |
| 3,328,236 | 6/1967 | Burgess, Jr. et al. | 162/342 |
| 3,432,383 | 3/1969 | Russell | 162/272 |
| 3,800,358 | 4/1974 | Ryan | 15/312.1 |
| 3,946,459 | 3/1976 | Armstrong | 15/377 |
| 3,970,513 | 7/1976 | Lehtinen | 162/272 |
| 4,071,919 | 2/1978 | Fields et al. | 15/21.1 |
| 4,073,302 | 2/1978 | Jones | 134/167 C |
| 4,216,561 | 8/1980 | Clifford | 15/104.31 |
| 4,539,075 | 9/1985 | Manjaniemi | 162/343 |
| 4,795,495 | 1/1989 | Dobson, Sr. | 134/8 |

*Primary Examiner*—W. Gary Jones
*Assistant Examiner*—Calvin Padgett
*Attorney, Agent, or Firm*—Luedeka, Neely & Graham

[57] ABSTRACT

Interior surfaces of a papermachine headbox slice plenum are mechanically cleaned by a method using scouring tools secured to a sled structure which is manually reciprocated within the slice plenum by tow ropes. Sled runners bear against the headbox tube sheet while the tool scouring bristles or surfaces compressively load against the convergent slice walls. Cleaning solution discharge nozzles supplied by a flexible conduit apply cleaning solution to the slice wall surfaces as the scouring occurs.

22 Claims, 2 Drawing Sheets

PAPERMACHINE HEADBOX CLEANING SYSTEM

BACKGROUND OF THE INVENTION

The present invention relates to methods and apparatus cleaning the interior surfaces of papermachine headbox plenums.

Papermaking fiber and many performance enhancing compounds combined with the fiber to formulate a papermaking stock or furnish have either chemical or electrostatic tendencies to deposit upon or adhere to papermachine confinement or conduit surfaces. For such reasons, flow condition critical internal surfaces within a papermachine headbox are highly polished and are frequently cleaned.

Among such surfaces are those of a hydraulic or bunched tube headbox slice plenum. Converging interior surfaces of the headbox slice walls funnel stock flow between the walls into a slice nozzle for discharge upon a traveling, fourdrinier drainage screen.

The interior surfaces of these slice walls are highly polished and sometimes plated to inhibit accumulations of these contaminants. Nevertheless, imperfections remain as nucleating sites for contamination growth and spread.

Traditional air padded headboxes were voluminous enough for internal occupancy by workmen having access to nearly all the internal surface area. Periodically, accumulated deposits upon such internal surfaces were removed by manual scouring.

The advent of bunched tube headboxes essentially eliminated the internal headbox volume and replaced it with a high flow volume manifold connected to a slice plenum by a multiplicity of tubular conduits. All of these headbox interior surfaces are conveniently accessible for scouring, either by design or by tool; except the slice plenum. Proposed and attempted chemical and hydraulic techniques for cleaning the internal surfaces of a slice plenum have produced disappointing results. Mechanical scouring is eventually required.

It is, therefore, an object of the present invention to provide a method by which a manually inaccessible slice plenum may be mechanically scoured.

Another object of the present invention is to provide a tool by which a manually inaccessible slice plenum may be mechanically scoured.

Another object of the present invention is to provide remote mechanical method for cleaning inaccessible papermachine headbox internal surfaces without damaging highly polished steel surfaces.

SUMMARY OF THE INVENTION

These and other objects of the invention to be hereinafter described or made apparent are accomplished by a scouring apparatus and associated method using a sled based structure configured to fit within the triangular section of an elongated slice plenum.

Sled runners are secured to the frame structure for bearing against the tube sheet wall of the plenum. Converging frame surfaces are equipped with replaceable scouring devices such as brushes. Rope or other tensile drafting elements are secured to the frame ends for manual reciprocation through the plenum while the frame mounted scouring devices compressively bear against internal surfaces of the slice walls.

Simultaneous with the scouring, fluid conduits and nozzle means may be provided on the sled frame to discharge cleaning fluids on the slice walls.

All of the sled frame construction materials having potential contact with the plenum internal surfaces are of such texture and softness as to minimize any scratch or damage hazard. Many woods such as redwood and cypress are suitable. Also, many polymers such as polyethylene may be used for structural fabrication of the frame structure.

BRIEF DESCRIPTION OF THE DRAWINGS

Relative to the drawings wherein like reference characters designate like or similar elements throughout the several figures of the drawings.

DESCRIPTION OF PREFERRED EMBODIMENTS

Figure 1:
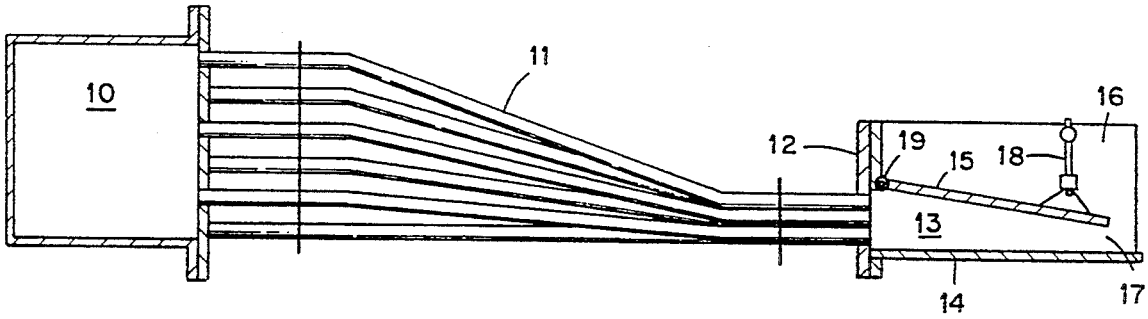
FIG. 1 is a sectioned, elevational schematic of a bunched tube type of papermachine headbox.

An example of the present invention utility environment is represented by FIG. 1 which illustrates a typical bunched tube type of papermachine headbox having a stock supply manifold 10 which includes a multiplicity of tubular conduits 11 having discharge ends secured to a tube sheet 12.

The tube sheet 12 constitutes one wall of a triangular section slice plenum 13 which is additionally defined by converging slice walls comprising a fixed slice apron 14 and a hinged slice beam 15. The slice plenum ends are structurally confined by removable checking pieces 16.

A multiplicity of slice jacks 18 are length adjustable hangers for positioning the precise angle the slice beam 15 is allowed about a respective hinge 15 and, therefore, the opening dimension of slice nozzle 17. Usually, the slice jacks 18 are screw mechanisms which secure a set slice beam position under either compressive or tensile load.

Not portrayed by the drawings is the disposition and close proximity of the headbox and slice nozzle 17 adjacent the fourdrinier screen across a twenty to thirty foot span over the fourdrinier wire pit. It is difficult to access the full width of the nozzle 17 for cleaning. The midspan of the slice nozzle is particularly difficult to access for cleaning without removal of the fourdrinier screen and the erection of temporary scaffolding. With sufficient disassembly, any part of the machine is accessible for maintenance. Inaccessibly is therefore understood in an economic context: what is the capital and labor cost of accessibility. The economic production value of the machine is lost while disassembled in addition to the labor value of disassembly and reconstruction. This invention is conceived to minimize both "down time" and maintenance labor thereby improving the "accessibility" of the slice plenum.

Operatively, the papermaking stock is pumped to the supply manifold 10 for final formation processing through the conduits 11 by generation of microturbulence which tends to disperse agglomerated fiber bundles. These dispersed, turbulent flow streams are delivered to the slice plenum 13 for slice configured discharge from the nozzle opening 17 onto the traveling fourdrinier screen in a manner well known to those of ordinary skill in the art.

The very nature of the papermaking process requires an application of materials having great natural affinities for bonding to adjacent surfaces including conduits and containers. Resultantly, many interior surface areas within the headbox, including the slice plenum 13, accumulate surface deposits of furnish constituents. Although many such deposits are removable by hot acid or caustic boil-out processes, others such as unreacted alkylsenic succinic anhydride (ASA) size material are extremely tenacious and require vigorous mechanical scouring for removal. Care, however, must be exercised in the selection of tools and materials to be used on the polished, internal headbox surfaces out of concern for scratching or scarring such surfaces and thereby exacerbating the deposit and tenacity problems.

Figure 2:
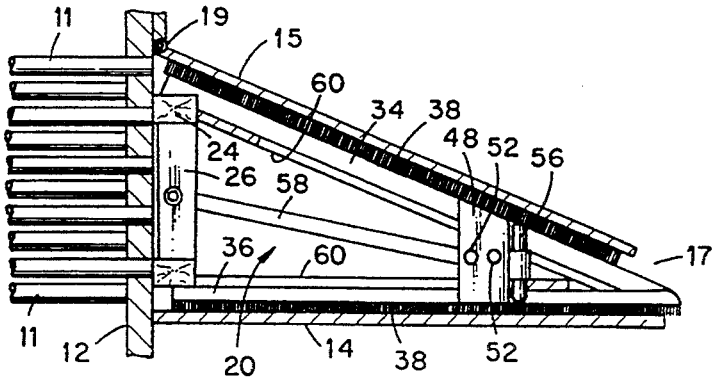
FIG. 2 is an enlarged detail of a slice plenum having the present invention scouring tool disposed therein; and, FIG. 3 is an isometric view of the present scouring tool.
Figure 3:
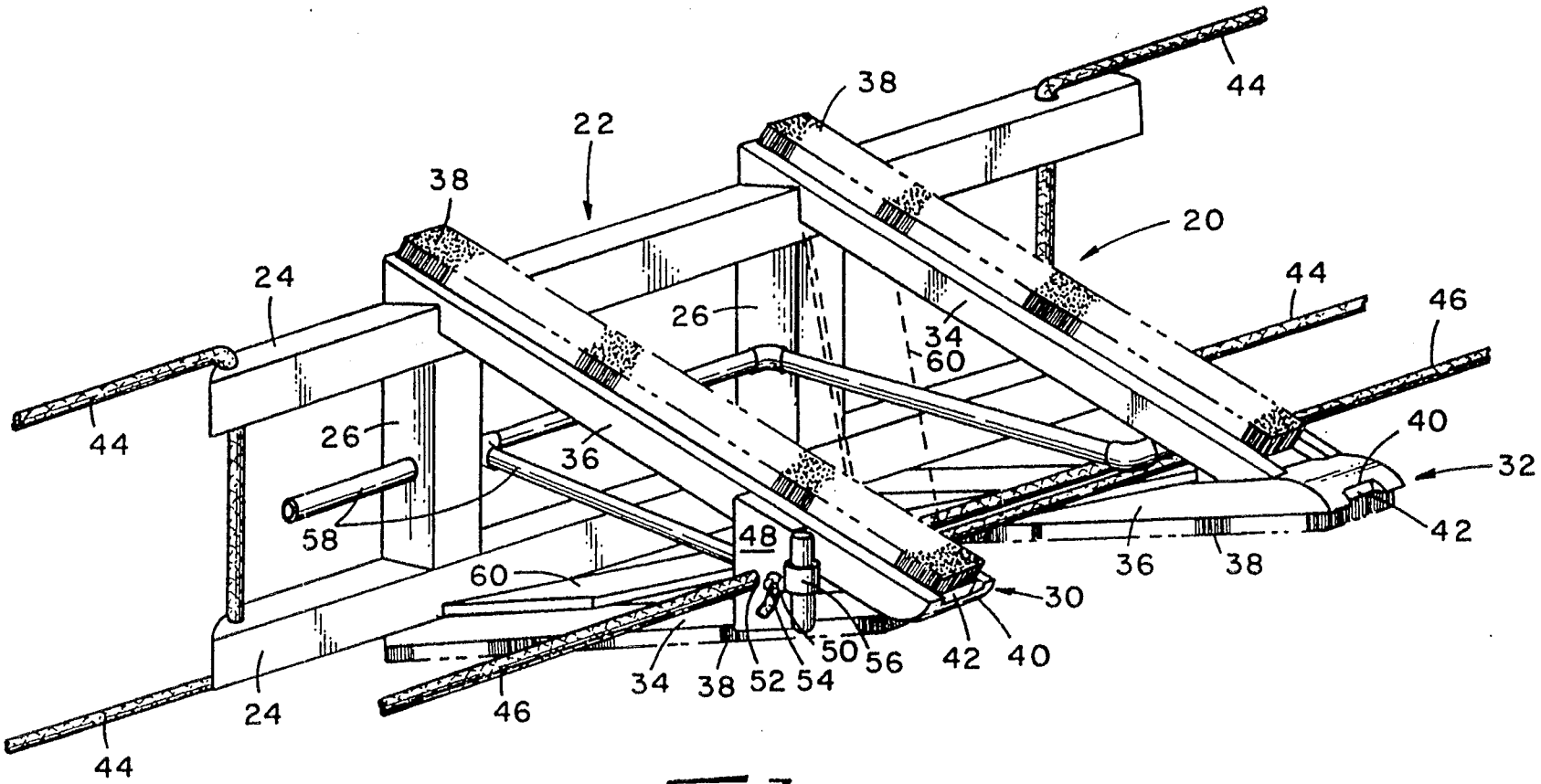

To overcome these and other problems, the tool 20 of FIGS. 2 and 3 which may be constructed of soft wood such as redwood is configured for insertion within the triangular section space of the slice plenum 13. Other soft woods such as cedar and white pine may be suitable as may some plastics. In overall geometry, the apparatus 20 in one embodiment generally conforms to a triangular section having a sled assembly 22 for a base plane. A pair of sled runners 24 spaced apart by beams 26 constitute a representative assembly design. Tow ropes 44 extending from both ends of the sled runners 24 provide simple but effective tensile drafting means to reciprocate the sled along the slice plenum length. Distal ends of the two ropes 44 are extended along the slice plenum 13 length to the papermachine tending and backsides, respectively, for cooperative manual manipulation.

Extending from the sled base 22 in the illustrated embodiment are a pair A-frames 30 and 32. Although both A-frames are substantially identical with a shaft leg 34 intersecting a longer leg 36 near the A-frame apex, note will be taken that the long leg 36 of A-frame 30 is in the upper converging plane as viewed in FIG. 3 whereas long leg 36 of A-frame 32 is in the lower converging plane. By this construction device, scouring structures such as brush bristles 38 may be more fully advanced into the narrow opening of the slice nozzle 17.

Channels 40 in the A-frame legs provide a stable mounting socket for brush handles 42 which may be secured by screw fasteners from the undersides of the A-frame leg members.

Those of ordinary skill in the art will understand there are many suitable bristle or scouring materials depending upon the nature of contamination. Normally, natural or synthetic fiber bristles will be used. However, bronze or polymer bristles may be used as scouring bristles. Moreover, there are other suitable scouring devices such as scouring screens supported on resilient pads, sponge or soft but rigid foam materials.

Preferably, the leg members 36 and 34 of A-frames 30 and 32, respectively, are dimensioned and arranged to place the respective brush bristles 38 or other scouring devices mounted on these leg members 36 and 34 in the same operating plane. Likewise, the brush bristles 38 in the opposite face converging plane are secured in the same scouring plane.

Figure 4:
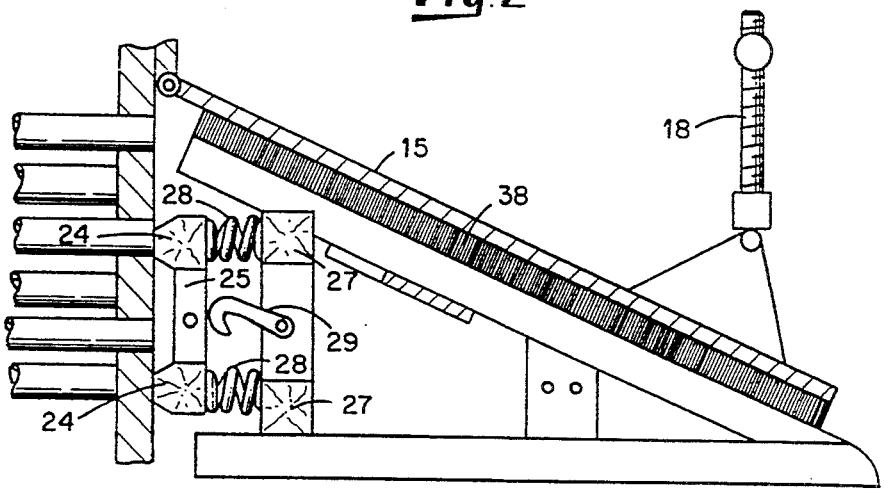
FIG. 4 is an orthographic section of an alternative embodiment of the invention.

One method of compressively loading the bristles or scouring elements against the interior plenum surfaces has been by the slice jacks 18, adjusted to close the slice beam 15 against the brush bristles. FIG. 4 illustrates on undercarriage 25 for the runners 24 bias from frame rails 27 by suspension springs 28. For example, such springs 28 could be compressed and releasably secured in a compressed state by a remote controlled latch mechanism 29. After placement in the plenum 13, the suspension springs are released whereupon the sled runners resiliently press against the tube wall 12.

Cleats 48 across the outer end faces of the respective A-frames near the apices are provided with the apertures 52 and 54. Apex tow ropes 46, extended from opposite sides of the papermachine, pass through the nearest aperture 52 to be secured to the remote cleat aperture 50 by means of an anchor knot 54.

Cleaning fluid dispensing nozzles 56, supplied by flexible tubing conduits 58, are also secured to the A-frames cleats 48. Appropriate cleaning solutions may be delivered through the conduit 58 means of a pump or pressurized reservoir.

Cross bracing 60 maintains the correct alignment of the A-frames while being reciprocated along the plenum 13.

Having fully disclosed my invention, those of ordinary skill in the art will perceive mechanical and functional equivalents for the same purposes. As my invention, therefore,

I claim:

1. An apparatus for mechanically scouring internal surfaces of a papermachine headbox slice plenum defining an elongate space bounded by a headbox tube sheet and a converging pair of slice walls, said apparatus comprising mechanical scouring means supported on sled runner means for being placed in bearing contact with the slice walls to remove deposits therefrom by reciprocal movement of said scouring means across said walls while bearing thereagainst, and tensile drafting means secured to said apparatus for reciprocating the same within the elongate space of the headbox slice plenum while maintaining surface contact pressure between said sled runner means and said headbox tube sheet and between said scouring means and said converging pair of slice walls, said apparatus being fabricated of appropriately soft materials for bearing against adjacent surfaces in the slice plenum so as to minimize injury thereto.

2. An apparatus as described by claim 1 wherein said mechanical scouring means comprises non-ferrous brush bristles.

3. An apparatus as described by claim 1 wherein said mechanical scouring means comprises resilient scouring padding.

4. An apparatus as described by claim 1 wherein said mechanical scouring means comprises sponge means.

5. An apparatus as described by claim 1 wherein said mechanical scouring means comprises a rigid polymer foam.

6. An apparatus as described by claim 1 wherein said mechanical scouring means comprises a triangular structure framed by A-frame members longitudinally separated along the space of the plenum and having said scouring brushes replaceably secured thereto.

7. An apparatus as described by claim 1 further comprising fluid distribution means for delivering cleaning solution to said slice walls in contact pressure with said scouring means.

8. An apparatus as described by claim 1 wherein said tensile drafting means comprises rope.

9. An apparatus as described by claim 1 wherein said mechanical scoring means is supported on said sled runner means by springs to bias said scouring means into compressive contact with said converging pair of slice walls.

10. An apparatus for mechanically scouring internal surfaces respective to a papermachine headbox slice plenum within a space bounded by a headbox tube sheet and a converging pair of slice walls, said apparatus comprising sled runner means forming the base of a substantially triangular support structure including two apex convergent surfaces, said convergent surfaces having mechanical scouring means secured thereto and tensile drafting means secured to said support structure for reciprocating same within said slice plenum in simultaneous surface contact pressure between said sled runner means and said headbox tube sheet and said scouring means with said converging slice walls, said support structure, scouring means and tensile means being fabricated of appropriately soft materials for sliding through said slice plenum without injury thereto.

11. An apparatus as described by claim 10 wherein said mechanical scouring means comprises non-ferrous brush bristles.

12. An apparatus as described by claim 10 wherein said mechanical scouring means comprises resilient scouring padding.

13. An apparatus as described by claim 10 wherein said mechanical scouring means comprises sponge means.

14. An apparatus as described by claim 10 wherein said mechanical scouring means comprises a rigid polymer foam.

15. An apparatus as described by claim 10 wherein said triangular structure is framed by A-frame members having said scouring means replaceably secured thereto.

16. An apparatus as described by claim 10 further comprising fluid distribution means for delivering cleaning solution to said slice walls in contact pressure with said scouring means.

17. An apparatus as described by claim 10 wherein said tensile drafting means comprises rope.

18. An apparatus as described by claim 10 wherein said support structure is resiliently suspended from said sled runner means to bias said scouring means against said converging slice walls.

19. A method of cleaning the internal surfaces of an elongate papermachine headbox slice plenum extended across said papermachine width and defined by a stock flow tube sheet, at least one hinged slice wall and a cooperative opposite slice wall, said hinged slice wall being pivoted about a hinge to adjust the magnitude of a slice opening relative to said cooperative slice wall, said method comprising the steps of placing elongate tensile means within the plenum, securing said tensile means to a cleaning apparatus having a base and mechanical scouring means supported on said base, positioning said tensile means secured cleaning apparatus within the plenum, compressing said cleaning apparatus between the internal surfaces of said tube sheet, said hinged slice wall and said cooperative opposite slice wall so that the scouring means compressively bears against the slice walls; and, with said tensile means, reciprocating said cleaning apparatus along said elongate slice plenum with the scouring means bearing against the slice walls as aforesaid to mechanically scour the internal surfaces of said slice walls with said scouring means.

20. A method as described by claim 19 wherein fluid cleaning solution is spread upon said slice walls as said scouring means is reciprocated along said slice plenum.

21. A method as described by claim 19 wherein said scouring means is biased away from said tube sheet and against said slice walls by resilient suspension means therebetween.

22. A method as described by claim 19 wherein said scouring means is compressed against said tube sheet and said opposite slice wall by said hinged slice wall.

* * * * *